US007605546B2

(12) United States Patent
Kimura

(10) Patent No.: US 7,605,546 B2
(45) Date of Patent: Oct. 20, 2009

(54) DISCHARGE LAMP LIGHTING APPARATUS AND SEMICONDUCTOR INTEGRATED CIRCUIT

(75) Inventor: Kengo Kimura, Niiza (JP)

(73) Assignee: Sanken Electric Co., Ltd., Niiza-shi (JP)

( * ) Notice: Subject to any disclaimer, the term of this patent is extended or adjusted under 35 U.S.C. 154(b) by 22 days.

(21) Appl. No.: 12/031,145

(22) Filed: Feb. 14, 2008

(65) Prior Publication Data

US 2008/0231208 A1 Sep. 25, 2008

(30) Foreign Application Priority Data

Mar. 20, 2007 (JP) ..... 2007-072093

(51) Int. Cl.
*H05B 37/02* (2006.01)
*H02M 3/335* (2006.01)

(52) U.S. Cl. ..... 315/291; 315/276; 315/307; 363/21.02; 363/41; 363/123

(58) Field of Classification Search ..... 315/209 R, 315/219, 224–226, 244, 247, 268, 276, 279, 315/291, 302, 307, 308, 312, 361, DIG. 7; 363/19, 21.01, 21.02, 34, 41, 77, 123, 127
See application file for complete search history.

(56) References Cited

U.S. PATENT DOCUMENTS 4,881,014 A * 11/1989 Okochi ..... 315/246
5,444,336 A * 8/1995 Ozawa et al. ..... 315/307
6,049,471 A * 4/2000 Korcharz et al. ..... 363/20
2006/0038508 A1 * 2/2006 Lin et al. ..... 315/276
2008/0231208 A1 9/2008 Kimura

FOREIGN PATENT DOCUMENTS

JP 2003-17287 1/2003

OTHER PUBLICATIONS

U.S. Appl. No. 12/391,594, filed Feb. 24, 2009, Kimura.

* cited by examiner

*Primary Examiner*—Douglas W Owens
*Assistant Examiner*—Jimmy T Vu
(74) *Attorney, Agent, or Firm*—Oblon, Spivak, McClelland, Maier & Neustadt, L.L.P.

(57) ABSTRACT

A discharge lamp lighting apparatus includes a triangular signal oscillator, a first control part to compare the triangular signal with an error voltage between a reference voltage and a voltage corresponding to a first current passed through a secondary winding of a transformer and generate a first PWM control signal for turning on/off switching elements Qp1 and Qn1 with a phase difference of about 180 degrees and a pulse width corresponding to the first current, and a second control part to compare the triangular signal with an error voltage between a reference voltage and a voltage corresponding to a second current passed through a secondary winding S2 of a transformer T2 and turn on/off switching elements Qp2 and Qn2 in synchronization with the first PWM control signal with a phase difference of about 180 degrees and a pulse width corresponding to the second current.

14 Claims, 12 Drawing Sheets

DISCHARGE LAMP LIGHTING APPARATUS AND SEMICONDUCTOR INTEGRATED CIRCUIT

BACKGROUND OF THE INVENTION

1. Field of the Invention

The present invention relates to a discharge lamp lighting apparatus and a semiconductor integrated circuit that turn on a discharge lamp such as a cold cathode fluorescent lamp used for, for example, a liquid-crystal display device.

2. Description of the Related Art

FIG. 1 is a circuit diagram showing a discharge lamp lighting apparatus according to a related art. In FIG. 1, bridge-connected between a DC power source Vin and a common potential (for example, the ground) are switching elements Q11 to Q14. The switching elements Q12 and Q14 are n-type MOSFETs and the switching elements Q11 and Q13 are p-type MOSFETs. Outputs from the bridge-connected switching elements Q11 to Q14 are connected through a capacitor C31 to a primary winding P1 of a transformer T1 and through a capacitor C32 to a primary winding P2 of a transformer T2.

A first end of a secondary winding S1 of the transformer T1 is connected to a first electrode of a cold cathode fluorescent lamp (hereinafter referred to as "discharge lamp") 32. A second end of the secondary winding S1 is connected through a resistor R31 to the common potential. A second electrode of the discharge lamp 32 is connected to a first end of a secondary winding S2 of the transformer T2 and a second end of the secondary winding S2 is connected through a resistor R32 to the common potential.

An error amplifier 33 compares a voltage of a diode D31 or D33 with a reference voltage and outputs an error voltage to a PWM comparator 35. The PWM comparator 35 compares the error voltage of the error amplifier 33 with a triangular signal of a triangular wave generator 34 and generates a pulse signal whose pulse width corresponds to the error voltage. A frequency divider 36 divides the frequency of the pulse signal from the PWM comparator 35 and outputs two drive signals for every pulse to drivers 37 and 38, respectively. The driver 37 provides the switching element Q11 with the signal from the frequency divider 36 and the switching element Q12 with an inverted signal of the signal from the frequency divider 36. The driver 38 provides the switching element Q13 with the signal from the frequency divider 36 and the switching element Q14 with an inverted signal of the signal from the frequency divider 36.

As a result, a period in which the switching elements Q11 and Q14 are simultaneously ON and a period in which the switching elements Q12 and Q13 are simultaneously ON are determined according to voltages detected with the resistors R31 and R32. The switching elements Q11 and Q12 or the switching elements Q13 and Q14 never simultaneously turn on. The period in which the switching elements Q11 and Q14 are simultaneously ON and the period in which the switching elements Q12 and Q13 are simultaneously ON alternate.

Operation of the discharge lamp lighting apparatus of FIG. 1 will be explained. When the switching elements Q11 and Q14 are turned on, the DC power source Vin passes a current through a path along Q11, C31, P1, Q14, and the common potential, to apply a voltage to the capacitor C31 and primary winding P1. As a result, the capacitor C31 and an inductance of the primary winding P1 resonate to form a sinusoidal current. When the switching elements Q11 and Q14 are turned on, the DC power source Vin passes a current through a path along Q11, C32, P2, Q14, and the common potential, to apply a voltage to the capacitor C32 and primary winding P2. As a result, the capacitor C32 and an inductance of the primary winding P2 resonate to form a sinusoidal current.

The secondary windings S1 and S2 are wound to generate high voltages that are sufficient to turn on the discharge lamp 32. Namely, the secondary windings S1 and S2 generate high voltages VL1 and VL2 of sinusoidal waves with opposite phases. As a result, the secondary side passes a current through a path along S1, 32, S2, R32, R31, and S1, to turn on the discharge lamp 32. The resistor R32 generates a voltage proportional to a current passed through the discharge lamp 32. This voltage is supplied through the diode D33 to the error amplifier 33. The resistor R31 generates a voltage that reversely biases the diode D31 and turns off the diode D31, which then provides no voltage.

When the switching elements Q12 and Q13 are turned on, the DC power source Vin passes a current through a path along Q13, P1, C31, Q12, and the common potential, to reversely apply a voltage to the capacitor C31 and primary winding P1. As a result, the secondary winding S1 produces a high voltage of sinusoidal wave with an opposite phase. Also, the DC power source Vin passes a current through a path along Q13, P2, C32, Q12, and the common potential, to normally apply a voltage to the capacitor C32 and primary winding P2. As a result, the secondary winding S2 generates a high voltage of sinusoidal wave with a normal phase. The secondary side passes a current through a path along S2, 32, S1, R31, R32, and S2, to turn on the discharge lamp 32. The resistor R31 generates a voltage proportional to a current passed through the discharge lamp 32. This voltage is supplied through the diode D31 to the error amplifier 33. The resistor R32 generates a voltage that reversely biases the diode D33 and turns off the diode D33, which then provides no voltage.

Consequently, the error amplifier 33 provides a current detection signal formed by alternately combining voltages generated by the resistors R31 and R32. According to the current detection signal, the PWM comparator 35 generates a pulse signal to turn on/off the switching elements Q11 to Q14, thereby controlling a current passed to the discharge lamp 32 to a constant value. The resistors R31 and R32 detect currents passing on the low-voltage sides of the secondary windings S1 and S2 of the transformers T1 and T2 that are arranged on each side of the discharge lamp 32, and the switching elements Q11 to Q14 arranged on each side of the discharge lamp 32 are PWM-controlled with the same pulse width to generate voltages of opposite phases on each side of the discharge lamp 32.

Another related art is disclosed in Japanese Unexamined Patent Application Publication No. 2003-17287. This related art is a power source apparatus with ground fault protection function for lighting a cold cathode discharge lamp, capable of preventing a malfunction due to a leakage current. This apparatus provides a secondary winding with a center tap. Based on a fact that the potential of the center tap changes relative to a common potential if a leakage current occurs, the apparatus detects whether or not there is a leakage current, and if there is, stops an inverter.

SUMMARY OF THE INVENTION

The apparatus shown in FIG. 1 is capable of normally lighting the discharge lamp 32 only if peripheral capacitance components Cs1 and Cs2 on each side of the discharge lamp 32 are nearly equal to each other so that voltages having the same effective value (wave height value) are generated with opposite phases on each side of the discharge lamp 32 to control a current passed through the discharge lamp 32 to a predetermined value. If the peripheral capacitance components of the discharge lamp 32 differ from each other, the related art is unable to normally turn on the discharge lamp 32. For example, if the peripheral capacitance Cs2 increases, a charge/discharge current related to the peripheral capacitance Cs2 increases and a resonance point decreases, to increase a current TI2' and the voltage VL2. Thus, a voltage Vd2 increases to narrow an ON pulse width of the PWM control. Consequently, a current TI1' decreases to reduce a current IL passed through the discharge lamp 32.

In addition, the quantity of power supplied by the transformer T1 decreases to decrease the output voltage VL1 of the transformer T1. If an increase in the peripheral capacitance Cs2 is large, voltages generated at the ends of the discharge lamp 32 become unable to keep turning on the discharge lamp 32. As a result, light emission from a positive column stops, and only the electrode receiving the voltage VL2 vaguely emits light in a one-side phoresis state.

Similarly, the apparatus disclosed in the Japanese Unexamined Patent Application Publication No. 2003-17287 is unable to stably maintain an ON state of a discharge lamp if peripheral capacitance values around the discharge lamp differ from each other.

The present invention provides a discharge lamp lighting apparatus and a semiconductor integrated circuit that can stably turn on a discharge lamp even if the discharge lamp involves peripheral capacitance values that differ from each other.

A first aspect of the present invention provides a discharge lamp lighting apparatus for converting a direct current into an alternating current of positive-negative symmetry and supplying power to a discharge lamp. The apparatus includes a first resonant circuit including a first transformer, a first capacitor connected to at least one of primary and secondary windings of the first transformer, and an output end connected to a first end of the discharge lamp; first and second switching elements connected to ends of a DC power source and configured to pass a current to the primary winding of the first transformer and the first capacitor; a second resonant circuit including a second transformer, a second capacitor connected to at least one of primary and secondary windings of the second transformer, and an output end connected to a second end of the discharge lamp, the second resonant circuit being configured to output an alternating current whose phase is opposite to the phase of an alternating current provided by the first resonant circuit; third and fourth switching elements connected to the ends of the DC power source and configured to pass a current to the primary winding of the second transformer and the second capacitor; an oscillator configured to generate a triangular signal; a first control part configured to generate a first PWM control signal according to the triangular signal from the oscillator and an error voltage between a first reference voltage and a voltage corresponding to a first current passed through the secondary winding of the first transformer, the first PWM control signal being used to turn on/off the first and second switching elements with a phase difference of about 180 degrees and a pulse width corresponding to the first current; and a second control part configured to turn on/off the third and fourth switching elements in synchronization with the first PWM control signal and according to the triangular signal from the oscillator and an error voltage between a second reference voltage and a voltage corresponding to a second current passed through the secondary winding of the second transformer, with a phase difference of about 180 degrees and a pulse width corresponding to the second current. The discharge lamp lighting apparatus individually carries out PWM control operations to generate alternating currents of opposite phases that are applied to the ends of the discharge lamp.

A second aspect of the present invention provides a semiconductor integrated circuit for controlling a plurality of switching elements that supply power to a discharge lamp, the switching elements including first and second switching elements that are connected to ends of a DC power source, to pass a current to a primary winding of a first transformer and a first capacitor and third and fourth switching elements that are connected to the ends of the DC power source, to pass a current to a primary winding of a second transformer and a second capacitor. The semiconductor integrated circuit includes an oscillator configured to generate a triangular signal; a first control part configured to generate a first PWM control signal according to the triangular signal from the oscillator and an error voltage between a first reference voltage and a voltage corresponding to a first current passed through the secondary winding of the first transformer, the first PWM control signal being used to turn on/off the first and second switching elements with a phase difference of about 180 degrees and a pulse width corresponding to the first current; and a second control part configured to turn on/off the third and fourth switching elements in synchronization with the first PWM control signal and according to the triangular signal from the oscillator and an error voltage between a second reference voltage and a voltage corresponding to a second current passed through the secondary winding of the second transformer, with a phase difference of about 180 degrees and a pulse width corresponding to the second current.

DESCRIPTION OF THE PREFERRED EMBODIMENT

Discharge lamp lighting apparatuses and semiconductor integrated circuits according to the embodiments of the present invention will be explained in detail with reference to the drawings.

First Embodiment

Figure 1:
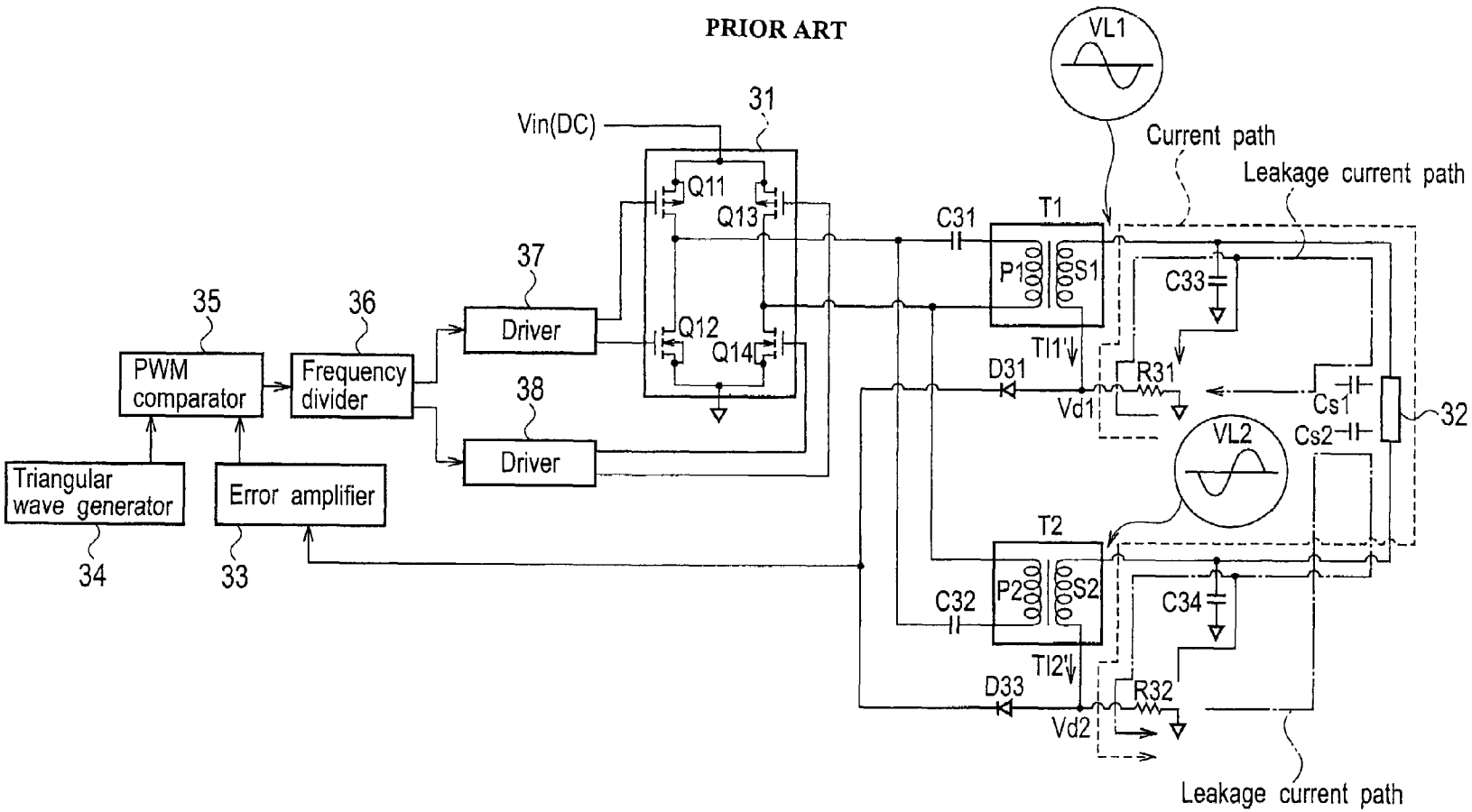
FIG. 1 PRIOR ART
FIG. 1 is a circuit diagram showing a discharge lamp lighting apparatus according to a related art.
Figure 2:
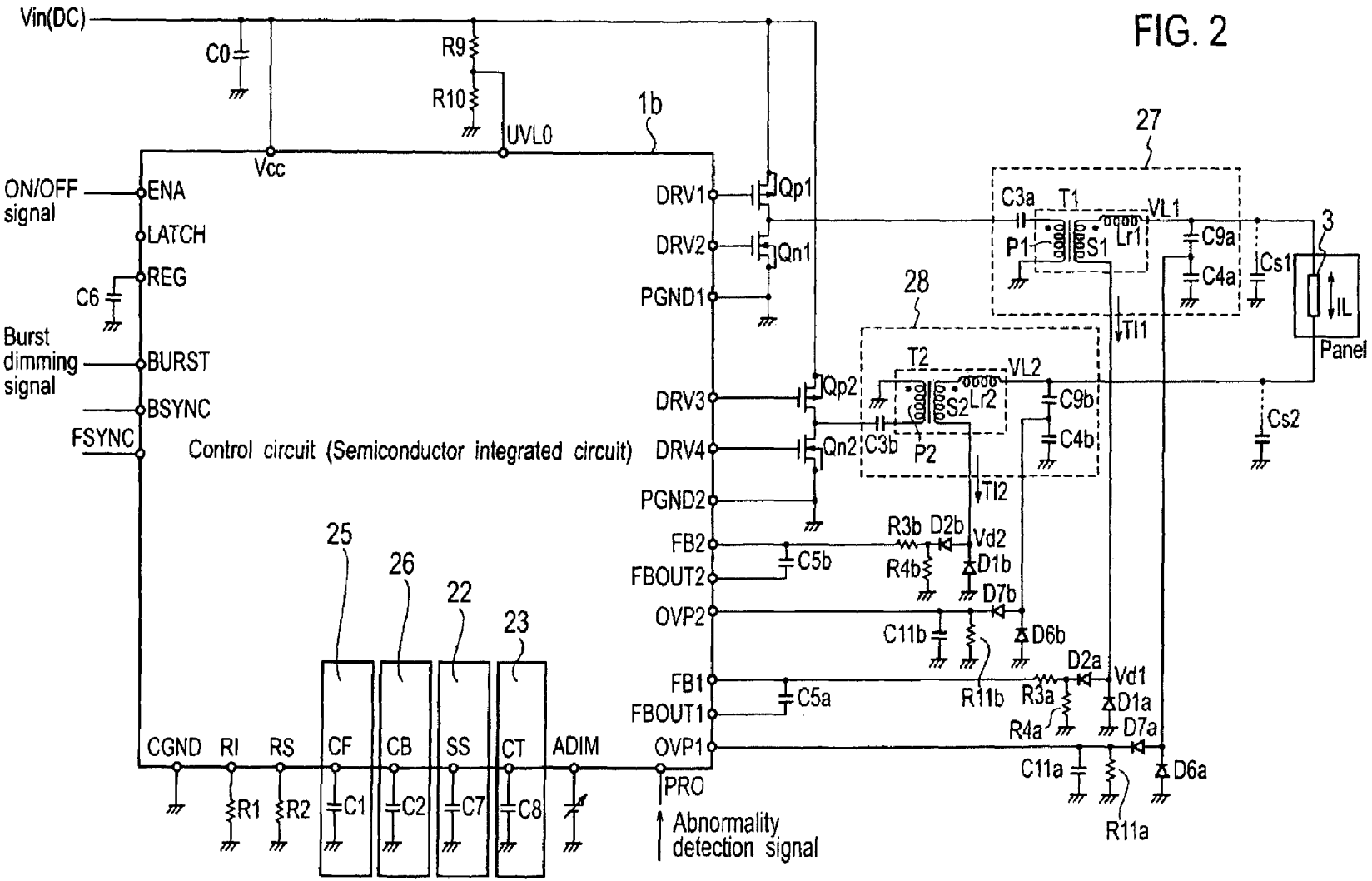
FIG. 2 is a circuit diagram showing a discharge lamp lighting apparatus according to a first embodiment of the present invention.
Figure 3A:
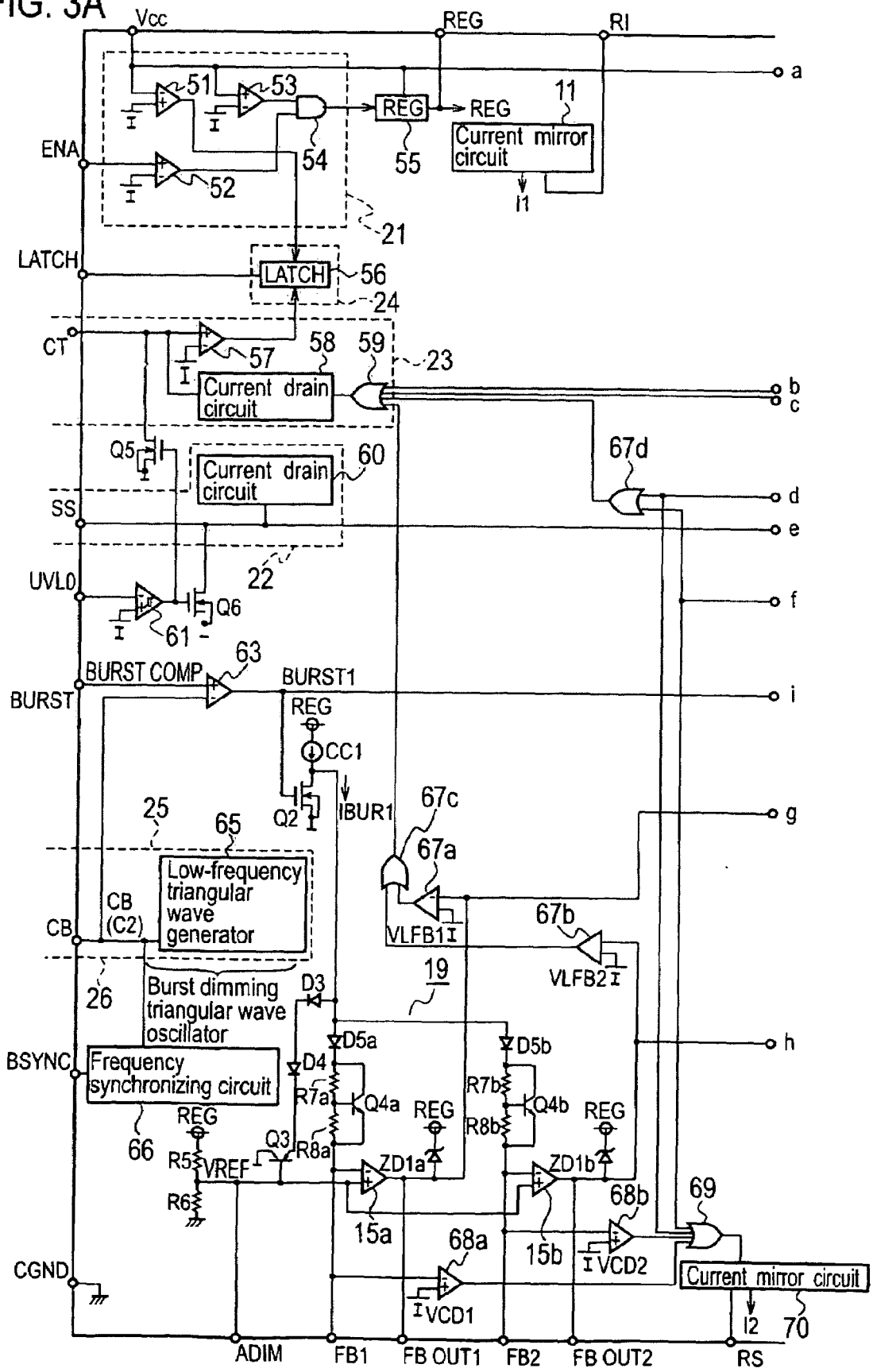
FIGS. 3A and 3B are circuit diagrams showing a semiconductor integrated circuit serving as a control circuit of the apparatus according to the first embodiment.
Figure 3B:
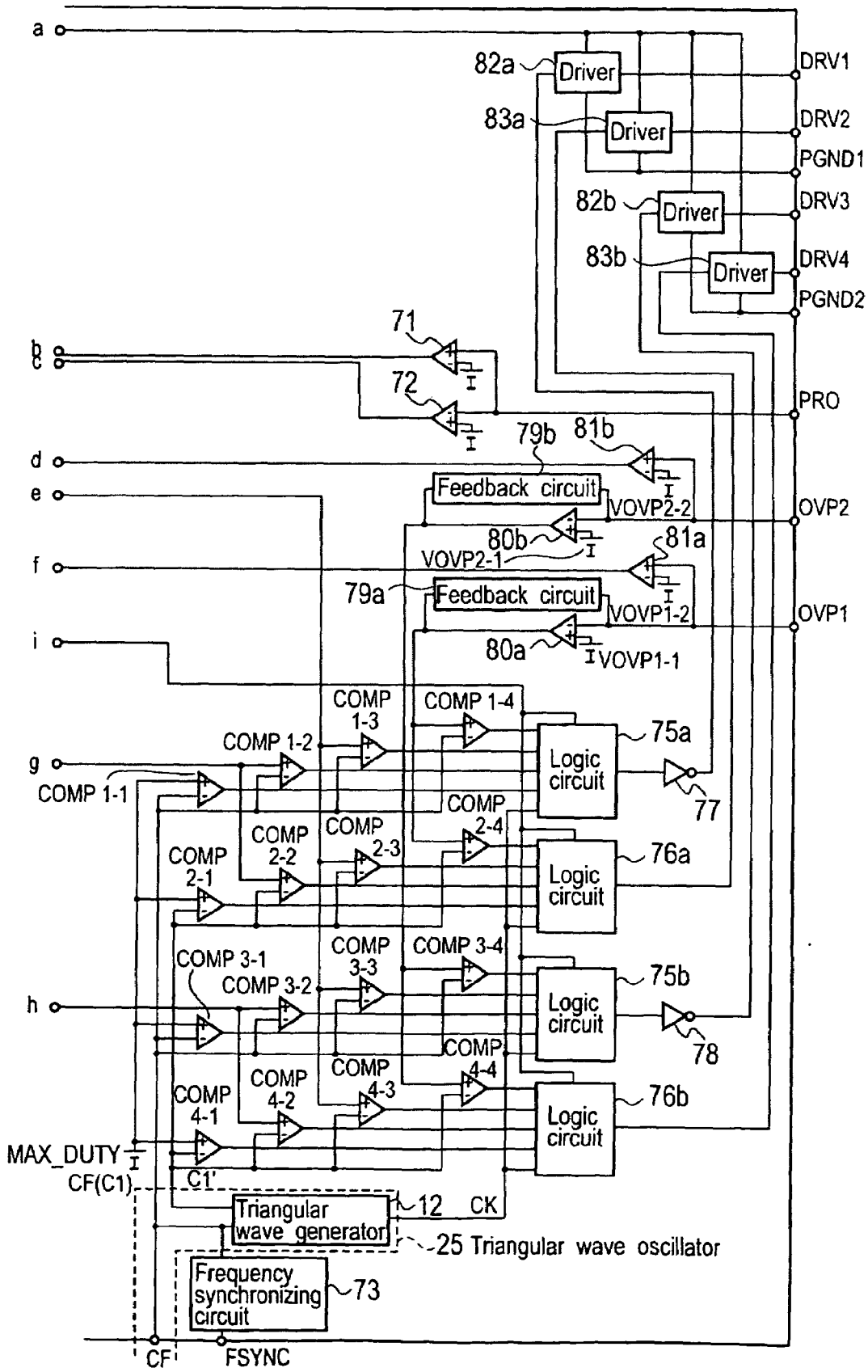

FIG. 2 is a circuit diagram showing a discharge lamp lighting apparatus according to the first embodiment of the present invention, FIG. 3A is a circuit diagram partly showing a semiconductor integrated circuit serving as a control circuit of the apparatus shown in FIG. 2, and FIG. 3B is a circuit diagram showing the remaining part of the semiconductor integrated circuit. Marks "a" to "i" shown in FIG. 3A correspond to marks "a" to "i" shown in FIG. 3B and points depicted by the same marks are connected to each other.

The discharge lamp lighting apparatus according to the first embodiment arranges, on opposite sides of a discharge lamp 3, a resonant circuit 27, transformers T1 and T2, a resonant circuit 28, and switching elements Qp1, Qn1, Qp2, and Qn2. These switching elements pass currents to the resonant circuits and transformers, to generate voltages of opposite phases at ends of the discharge lamp 3. Namely, the apparatus converts a direct current into an alternating current in positive-negative symmetry. More precisely, a first control part controls the switching elements Qp1 and Qn1 according to a first PWM control signal with a phase difference of 180 degrees and a pulse width corresponding to a current passed through a secondary winding S1 of the transformer T1. A second control part controls the switching elements Qp2 and Qn2 in synchronization with the first PWM control signal with a phase difference of 180 degrees and a pulse width corresponding to a current passed through a secondary winding S2 of the transformer T2. The first and second control parts are arranged on each side of the discharge lamp 3, to individually carry out PWM control and stably turn on the discharge lamp 3 even if peripheral capacitance values around the discharge lamp 3 differ from each other.

In FIG. 2, connected between a DC power source Vin and the ground is a series circuit including the high-side p-type MOSFET Qp1 (hereinafter referred to as "p-type FET Qp1") and low-side n-type MOSFET Qn1 (hereinafter referred to as "n-type FET Qn1"). Connected between a connection point of the p- and n-type FETs Qp1 and Qn1 and the ground GND is a series circuit including a capacitor C3*a* and a primary winding P1 of the transformer T1. A source of the p-type FET Qp1 is connected to the DC power source Vin and a gate thereof is connected to a terminal DRV1 of a control circuit 1*b*. A gate of the n-type FET Qn1 is connected to a terminal DRV2 of the control circuit 1*b*.

A first end of the secondary winding S1 of the transformer T1 is connected to a first end of the discharge lamp 3. The transformer T1 involves a leakage inductance component Lr1. A second end of the secondary winding S1 of the transformer T1 is connected to a cathode of a diode D1*a* and an anode of a diode D2*a*. The diodes D1*a* and D2*a* and a resistor R4*a* work as a lamp current detector that detects a current TI1 passed through the secondary winding S1 and outputs a voltage proportional to the detected current to a negative terminal of an error amplifier 15*a* through a resistor R3*a* and a terminal FB1 of the control circuit 1*b*.

Between the first end of the discharge lamp 3 and the ground, there is connected a series circuit including capacitors C9*a* and C4*a*. A connection point of the capacitors C9*a* and C4*a* is connected to a cathode of a diode D6*a* and an anode of a diode D7*a*. The diodes D6*a* and D7*a*, a resistor R11*a*, and a capacitor C11*a* work as a rectify-smooth circuit that detects a voltage proportional to an output voltage VL1 and outputs the detected voltage to a terminal OVP1 of the control circuit 1*b*.

Between the DC power source Vin and the ground, there is connected a series circuit including the p- and n-type FETs Qp2 and Qn2. Between a connection point of the p- and n-type FETs Qp2 and Qn2 and the ground, there is connected a series circuit including a capacitor C3*b* and a primary winding P2 of the transformer T2. A source of the p-type FET Qp2 is connected to the DC power source Vin and the gate thereof is connected to a terminal DRV3 of the control circuit 1*b*. A gate of the n-type FET Qn2 is connected to a terminal DRV4 of the control circuit 1*b*.

A first end of the secondary winding S2 of the transformer T2 is connected to a second end of the discharge lamp 3. The transformer T2 involves a leakage inductance component Lr2. A second end of the secondary winding S2 of the transformer T2 is connected to a cathode of a diode D1*b* and an anode of a diode D2*b*. The diodes D1*b* and D2*b* and a resistor R4*b* work as a lamp current detector that detects a current TI2 passed through the secondary winding S2 and outputs a voltage proportional to the detected current to a negative terminal of an error amplifier 15*b* through a resistor R3*b* and a terminal FB2 of the control circuit 1*b*.

Connected between the second end of the discharge lamp 3 and the ground is a series circuit including capacitors C9*b* and C4*b*. A connection point of the capacitors C9*b* and C4*b* is connected to a cathode of a diode D6*b* and an anode of a diode D7*b*. The diodes D6*b* and D7*b*, a resistor R11*b*, and a capacitor C11*b* work as a rectify-smooth circuit that detects a voltage proportional to an output voltage VL2 and outputs the detected voltage to a terminal OVP2 of the control circuit 1*b*.

The control circuit 1*b* includes first and second control parts. The first control part controls the switching elements Qp1 and Qn1 according to a first PWM control signal with a phase difference of 180 degrees and a pulse width corresponding to a current passed through the secondary winding S1 of the transformer T1. The second control part controls the switching elements Qp2 and Qn2 in synchronization with the first PWM control signal with a phase difference of 180 degrees and a pulse width corresponding to a current passed through the secondary winding S2 of the transformer T2.

The first control part includes the error voltage amplifier 15*a*, PWM comparators COMP1-2 and COMP2-2, logic circuits 75*a* and 76*a*, and an inverter 77. The error voltage amplifier 15*a* amplifies an error voltage between a reference voltage and a rectified-and-smoothed voltage supplied through the terminal FB1, i.e., a voltage corresponding to a current passed through the secondary winding S1 and outputs the amplified error voltage. The PWM comparator COMP1-2 compares the error voltage of the error voltage amplifier 15*a* with a triangular signal of a triangular wave generator 12 and generates a PWM control signal whose pulse width corresponds to the current passed through the secondary winding S1. The inverter 77 inverts the PWM control signal provided through the logic circuit 75*a* and outputs the inverted signal to the gate of the switching element Qp1 through a driver 82*a*. The PWM comparator COMP2-2 compares the error voltage of the error voltage amplifier 15*a* with an inverted signal formed by inverting the triangular signal of the triangular wave generator 12 at a midpoint of upper and lower limit values of the triangular signal and generates a PWM control signal whose pulse width corresponds to the current passed through the secondary winding S1. The logic circuit 76*a* outputs the PWM control signal to the gate of the switching element Qn1 through a driver 83*a*.

The second control part includes the error voltage amplifier 15*b*, PWM comparators COMP3-2 and COMP4-2, logic circuits 75*b* and 76*b*, and an inverter 78. The error voltage amplifier 15*b* amplifies an error voltage between a reference voltage and a rectified-and-smoothed voltage supplied through the terminal FB2, i.e., a voltage corresponding to a current passed through the secondary winding S2 and outputs the amplified error voltage. The PWM comparator COMP3-2 compares the error voltage of the error voltage amplifier 15*b* with the triangular signal of the triangular wave generator 12 and generates a PWM control signal whose pulse width corresponds to the current passed through the secondary winding S2. The inverter 78 inverts the PWM control signal provided through the logic circuit 75*b* and outputs the inverted signal to the gate of the switching element Qp2 through a driver 82*b*. The PWM comparator COMP4-2 compares the error voltage of the error voltage amplifier 15*b* with the inverted signal formed by inverting the triangular signal of the triangular wave generator 12 at a midpoint of the upper and lower limit values of the triangular signal and generates a PWM control signal whose pulse width corresponds to the current passed through the secondary winding S2. The logic circuit 76*b* outputs the PWM control signal to the gate of the switching element Qn2 through a driver 83*b*.

If peripheral capacitance Cs2 of the discharge lamp 3 shown in FIG. 2 increases, a charge/discharge current related to the peripheral capacitance Cs2 increases and a resonance point decreases, to increase the current TI2 and voltage VL2. This results in increasing a voltage Vd2, which is transferred through the terminal FB2 to the error amplifier 15*b*. As a result, the second control part narrows the ON pulse width of the PWM control signal to the switching elements Qp2 and Qn2.

Then, the current TI1 becomes smaller to decrease a voltage Vd1, which is transferred through the terminal FB1 to the error amplifier 15*a*. Then, the first control part returns the voltage Vd1 to a predetermined value by widening the ON pulse width of the PWM control signal to the switching elements Qp1 and Qn1. Consequently, a current passed through the discharge lamp 3 is unchanged even if the peripheral capacitance Cs2 increases.

The transformer T1 continuously supplies power corresponding to the current TI1, and therefore, the output voltage VL1 of the transformer T1 shows no decrease. Even if the peripheral capacitance Cs2 greatly increases, i.e., even if peripheral capacitance values around the discharge lamp 3 greatly differ from each other, voltages normally turning on the discharge lamp 3 are generated at the ends of the discharge lamp 3. As a result, the discharge lamp 3 is stably turned on.

Details of the Control Circuit

The details of the control circuit 1*b* will be explained. The control circuit 1*b* includes current mirror circuits 11 and 70, the error amplifiers 15*a* and 15*b*, a start-stop circuit 21, a soft start circuit 22, a timer circuit 23, an output shutdown circuit 24, a triangular wave oscillator 25, a burst dimming triangular wave oscillator 26, the PWM comparators COMP1-1 to COMP4-4, the logic circuits 75*a* to 76*b*, the inverters 77 and 78, and the drivers 82*a* to 83*b*.

In the start-stop circuit 21, a comparator 53 receives a voltage from a terminal Vcc and a comparator 52 receives a voltage from a terminal ENA. If the voltages from the terminals Vcc and ENA exceed predetermined start voltages, an AND circuit 54 provides a high-level output to start an internal regulator 55. As a result, a voltage from a terminal REG is supplied to various parts.

If the voltage from the terminal ENA is equal to or lower than the predetermined start voltage, the AND circuit 54 blocks the voltage from the terminal Vcc and the internal regulator 55 nearly zeroes a current consumed by the control circuit (IC) 1*b* during a standby period.

When the internal regulator 55 becomes operative, various parts of the control circuit 1*b* start to operate. This operation will be explained in detail.

In a steady state, the current mirror circuit 11 and a constant current determination resistor R1 connected to a terminal RI optionally set a current I1. Also, the current mirror circuit 70 and a constant current determination resistor R2 connected to a terminal RS optionally set a current I2. The sum of the currents I1 and I2 charges/discharges an oscillator capacitor C1 connected to a terminal CF, to generate a triangular signal whose rise and fall have the same inclination.

Currents passed through the discharge lamp 3 are converted by the resistors R4*a* and R4*b* into voltages, which are applied to the terminals FB1 and FB2, respectively. When currents start to pass through the discharge lamp 3, the voltages at the terminals FB1 and FB2 increase. When these voltages exceed voltages VCD1 and VCD2 that are set to be lower than the reference voltages (prepared by dividing the source voltage REG with resistors R5 and R6) of the error amplifiers 15*a* and 15*b*, comparators 68*a* and 68*b* provide low-level outputs. At this time, if the voltages at the terminals OVP1 and OVP2 are equal to or lower than reference voltages VOVP1-2 and VOVP2-2 of OVP comparators 81*a* and 81*b*, an OR circuit 69 provides a low-level output.

Then, the current I2 supplied by the current mirror circuit 70 is blocked and the capacitor C1 is charged/discharged only with the current I1. Namely, until currents are normally passed through the discharge lamp 3, voltages are applied to the discharge lamp 3 at an oscillation frequency that is lower than a steady-state oscillation frequency, to increase the gain of each resonant circuit and raise each output voltage. At the same time, the proximity effect of a panel as a load improves the lighting characteristic of the discharge lamp 3.

An oscillation frequency used for PWM control of the first control part and an oscillation frequency used for PWM control of the second control part are simultaneously changed to prevent turn-on errors.

The triangular signal C1 is supplied to the negative terminal of each of the PWM comparators COMP1-1, COMP1-2, COMP1-3, COMP1-4, COMP3-1, COMP3-2, COMP3-3, and COMP3-4. An inverted signal C1' prepared by inverting the triangular signal CF(C1) with respect to a midpoint of upper and lower limit values of the triangular signal is supplied to the negative terminal of each of the PWM comparators COMP2-1, COMP2-2, COMP2-3, COMP2-4, COMP4-1, COMP4-2, COMP4-3, and COMP4-4.

Just after a rise of the voltage REG, a soft start capacitor C7 connected to a terminal SS is charged with a constant current, and therefore, the voltage of the capacitor C7 gradually increases. The voltage of the capacitor C7 at the terminal SS is supplied to the positive terminal of each of the PWM comparators COMP1-3, COMP2-3, COMP3-3, and COMP4-3. Each of these PWM comparators compares the voltages at the positive and negative terminals thereof with each other and outputs a pulse voltage according to the comparison result.

The terminal FB1 is connected to the negative terminal of the error amplifier 15*a* and the output of the error amplifier

15*a* is connected to a terminal FBOUT1, which is connected to the positive terminal of each of the PWM comparators COMP1-2 and COMP2-2. Each of these PWM comparators compares the voltages at the positive and negative terminals thereof with each other and outputs a pulse voltage according to the comparison result.

Figure 4:
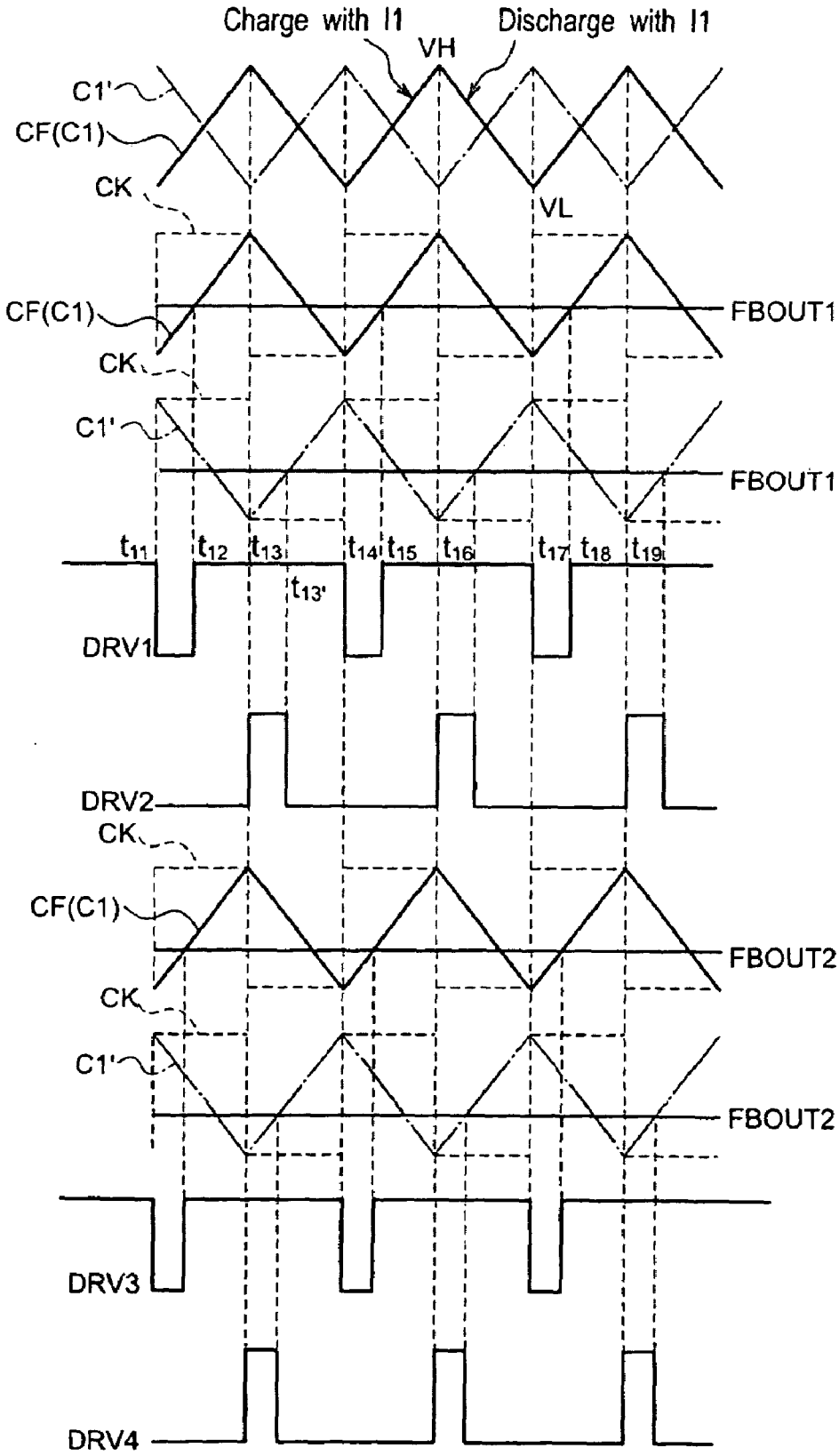
FIG. 4 is a view showing the operational waveforms of signals for driving switching elements arranged in the apparatus of the first embodiment.

The terminal FB2 is connected to the negative terminal of the error amplifier 15*b*. The output of the error amplifier 15*b* is connected to a terminal FBOUT2, which is connected to the positive input terminal of each of the PWM comparators COMP3-2 and COMP4-2. Each of these PWM comparators compares the voltages at the positive and negative input terminals thereof with each other and outputs a pulse voltage according to the comparison result. FIG. 4 shows waveforms of the triangular signal CF (C1), a clock signal CK provided by the triangular wave oscillator 12, and signals DRV1 to DRV4 for driving the switching elements. A capacitor C5*a* between the terminals FB1 and FBOUT1 conducts phase compensation for the error amplifier 15*a*. A capacitor C5*b* between the terminals FB2 and FBOUT2 conducts phase compensation for the error amplifier 15*b*.

An output voltage of the discharge lamp lighting apparatus is divided by the capacitors C9*a* and C4*a*, is rectified and smoothed, and is supplied to the terminal OVP1. Another output voltage of the discharge lamp lighting apparatus is divided by the capacitors C9*b* and C4*b*, is rectified and smoothed, and is supplied to the terminal OVP2.

The voltage applied to the terminal OVP1 is amplified by an amplifier 80*a* and the amplified voltage is supplied to the positive terminal of each of the PWM comparators COMP1-4 and COMP2-4. Each of these PWM comparators compares the voltages at the positive and negative input terminals thereof with each other and outputs a pulse voltage according to the comparison result. The voltage applied to the terminal OVP2 is amplified by an amplifier 80*b* and the amplified voltage is supplied to the positive terminal of each of the PWM comparators COMP3-4 and COMP4-4. Each of these PWM comparators compares the voltages at the positive and negative input terminals thereof with each other and outputs a pulse voltage according to the comparison result.

The PWM comparators COMP1-1, COMP2-1, COMP3-1, and COMP4-1 are each a comparator to determine a maximum ON duty. The positive input terminal of each of these PWM comparators receives a maximum duty voltage MAX_DUTY that is set to be slightly lower than the upper limit voltage of the triangular signal CF(C1) and the upper limit voltage of the inverted signal CF(C1') prepared by inverting the triangular signal CF(C1) at a midpoint of the upper and lower limit values of the triangular signal. Each of these PWM comparators compares the voltages at the positive and negative input terminals thereof with each other and outputs a pulse voltage according to the comparison result.

Among the output pulse voltages from the PWM comparators COMP1-1, COMP1-2, COMP1-3, and COMP1-4, the logic circuit 75*a* selects one having a shortest pulse width and sends the selected output pulse voltage through the inverter 77 and driver 82*a* to the terminal DRV1 only during a rise period of the triangular signal CF(C1). Among the output pulse voltages from the PWM comparators COMP2-1, COMP2-2, COMP2-3, and COMP2-4, the logic circuit 76*a* selects one having a shortest pulse width and sends the selected output pulse voltage through the driver 83*a* to the terminal DRV2 only during a rise period of the inverted signal C1'.

Among the output pulse voltages of the PWM comparators COMP3-1, COMP3-2, COMP3-3, and COMP3-4, the logic circuit 75*b* selects one having a shortest pulse width and sends the selected output pulse voltage through the inverter 78 and driver 82*b* to the terminal DRV3 only during a rise period of the triangular signal CF(C1). Among the output pulse voltages of the PWM comparators COMP4-1, COMP4-2, COMP4-3, and COMP4-4, the logic circuit 76*b* selects one having a shortest pulse width and sends the selected output pulse voltage through the driver 83*b* to the terminal DRV4 only during a rise period of the inverted signal C1'.

The operation mentioned above turns on/off the p- and n-type FETs Qp1 and Qn1 alternately, and also, turns on/off the p- and n-type FETs Qp2 and Qn2 alternately. These switching operations are carried out according to the waveform of the triangular signal CF(C1) at the same frequency, the same phase, and pulse widths determined by the feedback control of the error amplifiers 15*a* and 15*b*. Due to this, power of opposite phases and currents of controlled values is supplied to the discharge lamp 3. When the output of the discharge lamp lighting apparatus is open, voltages at the terminals OVP1 and OVP2 increase. When the voltages at the terminals OVP1 and OVP2 reach the reference voltages VOVP1-1 and VOVP2-1 of the amplifiers 80*a* and 80*b*, the feedback control of the amplifiers 80*a* and 80*b* controls the open output voltages of the discharge lamp lighting apparatus to predetermined values.

Also, when the output of the discharge lamp lighting apparatus is open and when the voltage at the terminal OVP1 or OVP2 exceeds a corresponding one of the reference voltages VOVP1-2 and VOVP2-2 of the comparators 81*a* and 81*b* that are set to be slightly lower than the voltages VOVP1-1 and VOVP2-1, the corresponding one of the comparators 81*a* and 81*b* provides the OR circuit 67*d* with a high-level output. Then, the OR circuit 59 provides a high-level output to make a current drain circuit 58 pass a current. As a result, the timer capacitor C8 connected to the terminal CT is charged, and therefore, the voltage of the capacitor C8 gradually increases.

If no current is passed through the discharge lamp 3, the voltages at the terminals FB (FB1, FB2) each become zero to increase the outputs of the error amplifiers 15*a* and 15*b*. When the voltages at the terminals FBOUT (FBOUT1, FBOUT2) exceed voltage values VLFB (VLFB1, VLFB2), the OR circuits 67*c* and 59 each provide a high-level output, to make the current drain circuit 58 pass a current. As a result, the timer capacitor C8 connected to the terminal CT is charged with a constant current, and therefore, the voltage of the capacitor C8 gradually increases.

A terminal PRO is connected to window comparators 71 and 72 that are capable of detecting, in combination with optional applications, abnormal states such as an overcurrent passed to the transformer T and a low output voltage of the discharge lamp lighting apparatus. If a voltage at the terminal PRO exceeds a threshold value of any one of the window comparators 71 and 72, the timer capacitor C8 connected to the terminal CT is charged with a constant current through the current drain circuit 58, and therefore, the voltage of the capacitor C8 gradually increases.

When the voltage at the terminal CT exceeds a threshold voltage set for an amplifier 57, the amplifier 57 provides a latch circuit 56 with a high-level output, so that the outputs (DRV1 and DRV2) of the control circuit 1*b* are shut down in a latch mode. If the abnormal state returns to a normal state during the operation of the timer, the charge of the timer capacitor C8 is reset. When the voltage at the terminal Vcc becomes equal to or lower than a latch release voltage, an amplifier 51 provides the latch circuit 56 with a high-level output, to release the latch mode.

A terminal LATCH is at a high-level state during a normal operation and becomes a low-level state when the control circuit 1*b* is put in the latch mode, to inform other control circuits and systems of the low-level state, i.e., an abnormal state.

Figure 5:
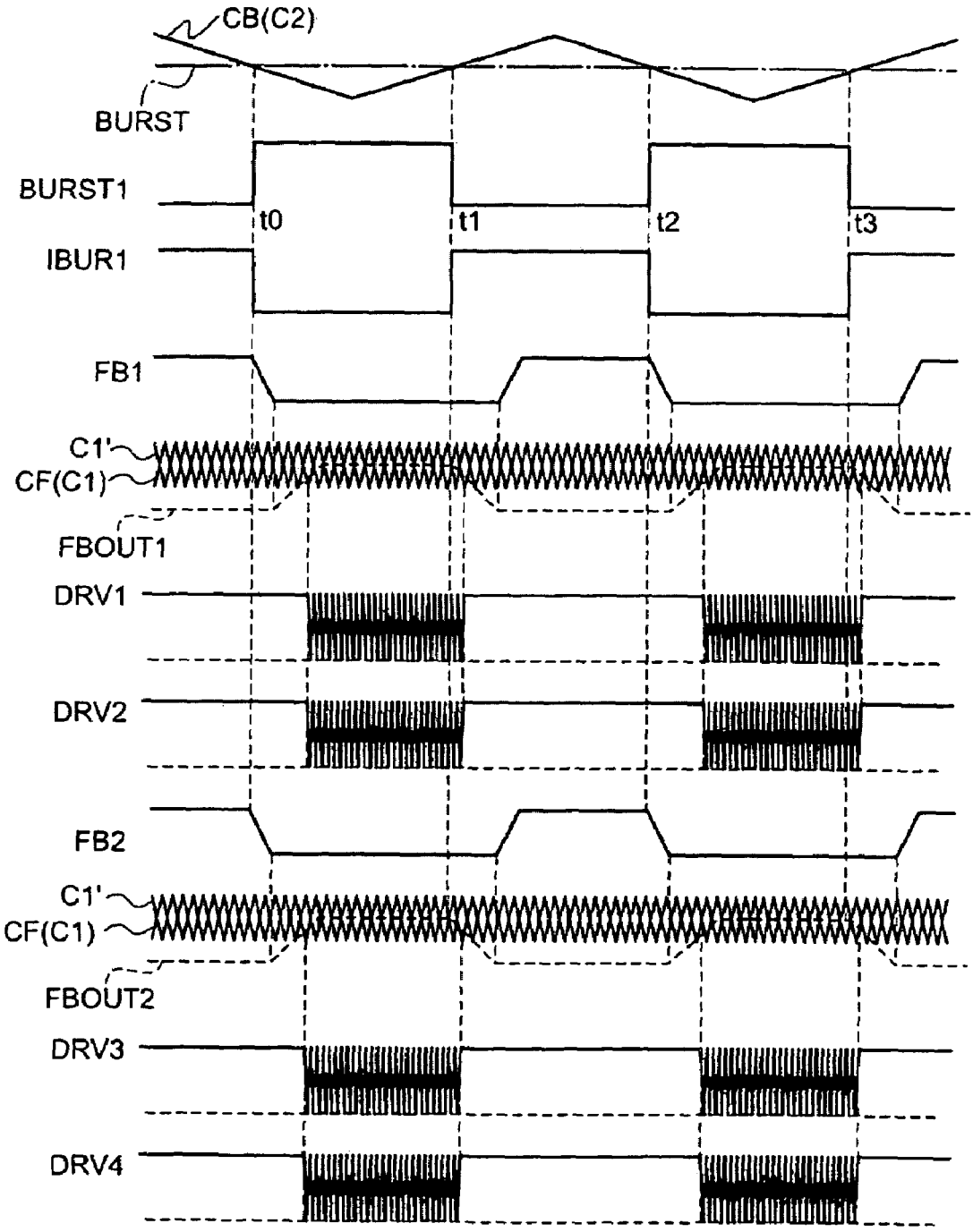
FIG. 5 is a view showing waveforms related to a burst dimming operation carried out by the apparatus of the first embodiment.

A burst dimming operation will be explained. FIG. 5 is a view showing waveforms related to the burst dimming operation carried out by the discharge lamp lighting apparatus according to the first embodiment. Based on the constant current determination resistor R1 connected to the terminal RI, the current mirror circuit 11 optionally sets the current I1. According to the current I1, a low-frequency-oscillation capacitor C2 connected to a terminal CB is charged and discharged, to generate a low-frequency triangular signal whose rise angle and fall angle are equal to each other.

A burst dimming comparator 63 compares the voltage of the capacitor C2 at the terminal CB with an input voltage at a terminal BURST, and if the voltage at the terminal BURST is lower than the voltage of the capacitor C2, supplies a low-level output to a gate of an n-type FET Q2. Since the n-type FET Q2 is OFF, a current passes through a path extending along REG, CC1, D5*a*, Q4*a*, R3*a*, R4*a*, and the ground. Also, a current passes through a path extending along REG, CC1, D5*b*, Q4*b*, R3*b*, R4*b*, and the ground. This results in passing the currents out of the terminals FB1 and FB2, to set voltages at the negative terminals of the error amplifiers 15*a* and 15*b* to voltages that are determined by the clamp circuit 19 and are slightly higher than voltages at the positive terminals of the error amplifiers 15*a* and 15*b*. As a result, the outputs FBOUT1 and FBOUT2 of the error amplifiers 15*a* and 15*b* operate to reduce power to be supplied to the discharge lamp 3.

At the same time, Zener diodes ZD1*a* and ZD1*b* clamp the outputs FBOUT1 and FBOUT2 of the error amplifiers 15*a* and 15*b* so that the outputs FBOUT1 and FBOUT2 may not decrease below the lower limit value of the triangular signal. The PWM comparators COMP1-2, COMP2-2, COMP3-2, and COMP4-2 are in a standby state in which they are ready to provide very-short PWM control signals. The logic circuits 75*a*, 76*a*, 75*b*, and 76*b* block the PWM control signals to stop oscillation outputs. As a result, in a case where the voltage at the terminal BURST is a pulse signal exceeding the upper and lower limit values of the capacitor C2 or a DC voltage within the upper and lower limit values of the capacitor C2, pulse currents are provided from the terminals FB1 and FB2, oscillations are intermittently generated to reduce power supply, and thus the burst dimming operation is performed.

At the start of an ON period of the burst dimming operation, the error amplifiers 15*a* and 15*b* operate as integration circuits in combination with the capacitors C5*a* and C5*b* and resistors R3*a*, R3*b*, R4*a* and R4*b* between the terminals FB1, FB2, FBOUT1, and FBOUT2, so that the output voltages of the error amplifiers 15*a* and 15*b* may gradually increase. As a result, the voltage and current of the discharge lamp 3 gradually increase. With this, the discharge lamp 3 can quickly turn on from a soft start action that prevents an excessive stress on the discharge lamp 3.

A terminal ADIM is connected to the positive terminals of the error amplifiers 15*a* and 15*b*. With the use of a variable voltage supplied to the terminal ADIM, the reference voltage of the error amplifiers 15*a* and 15*b* is variable in an up-down direction, to widen the range of current dimming.

A terminal UVLO is connected to a hysteresis comparator 61. If a voltage at the terminal UVLO is equal to or lower than a predetermined voltage, the hysteresis comparator 61 turns on an n-type FET Q5 so that the amplifier 57 may output a low-level signal to the latch circuit 56 to block signals to the latch circuit 56. At the same time, the terminal SS is set to low to cut off the outputs of the control circuit 1*b*. When the voltage at the terminal UVLO exceeds the predetermined voltage, the signal to the latch circuit 56 and the signal to set the terminal SS to low are released and the outputs of the control circuit 1*b* are resumed from a soft start action. By applying a voltage proportional to an input source voltage supplied to the discharge lamp lighting apparatus to the terminal UVLO, an undervoltage lockout operation can be performed for the input source voltage supplied to the discharge lamp lighting apparatus.

A terminal FSYNC is an external synchronizing signal input terminal and is connected to a frequency synchronizing circuit 73. The triangular signal CF(C1) oscillates at the frequency of a pulse signal from the frequency synchronizing circuit 73. A terminal BSYNC is an external synchronizing signal input terminal and is connected to a frequency synchronizing circuit 66. The triangular signal CB(C2) oscillates at the frequency of a pulse signal from the frequency synchronizing circuit 66. Terminals PGND (PGND1, PGND2) are for grounding the output drivers 82*a*, 82*b*, 83*a*, and 83*b*. A terminal CGND is for grounding parts of the control circuit 1*b* other than the output drivers 82*a* to 83*b*.

The first and second control parts share the start-stop circuit 21, soft start circuit 22, output shutdown circuit 24, and burst dimming triangular wave oscillator 25. At the start of operation of the discharge lamp lighting apparatus, the start-stop circuit 21 and soft start circuit 22 simultaneously and gradually increase and supply power to the first and second control parts. At the stoppage of operation of the discharge lamp lighting apparatus, the start-stop circuit 21 simultaneously stops supplying power to the first and second control parts. When carrying out the burst dimming operation, the burst dimming triangular wave oscillator 25 simultaneously provides the first and second control parts with a burst dimming signal to intermittently supply power to the discharge lamp 3. If an abnormality is detected, the output shutdown circuit 24 simultaneously stops supplying power to the first and second control parts. In this way, control can be carried out without causing a time lag between opposite-phase voltages at the ends of the discharge lamp 3.

Second Embodiment

Figure 6A:
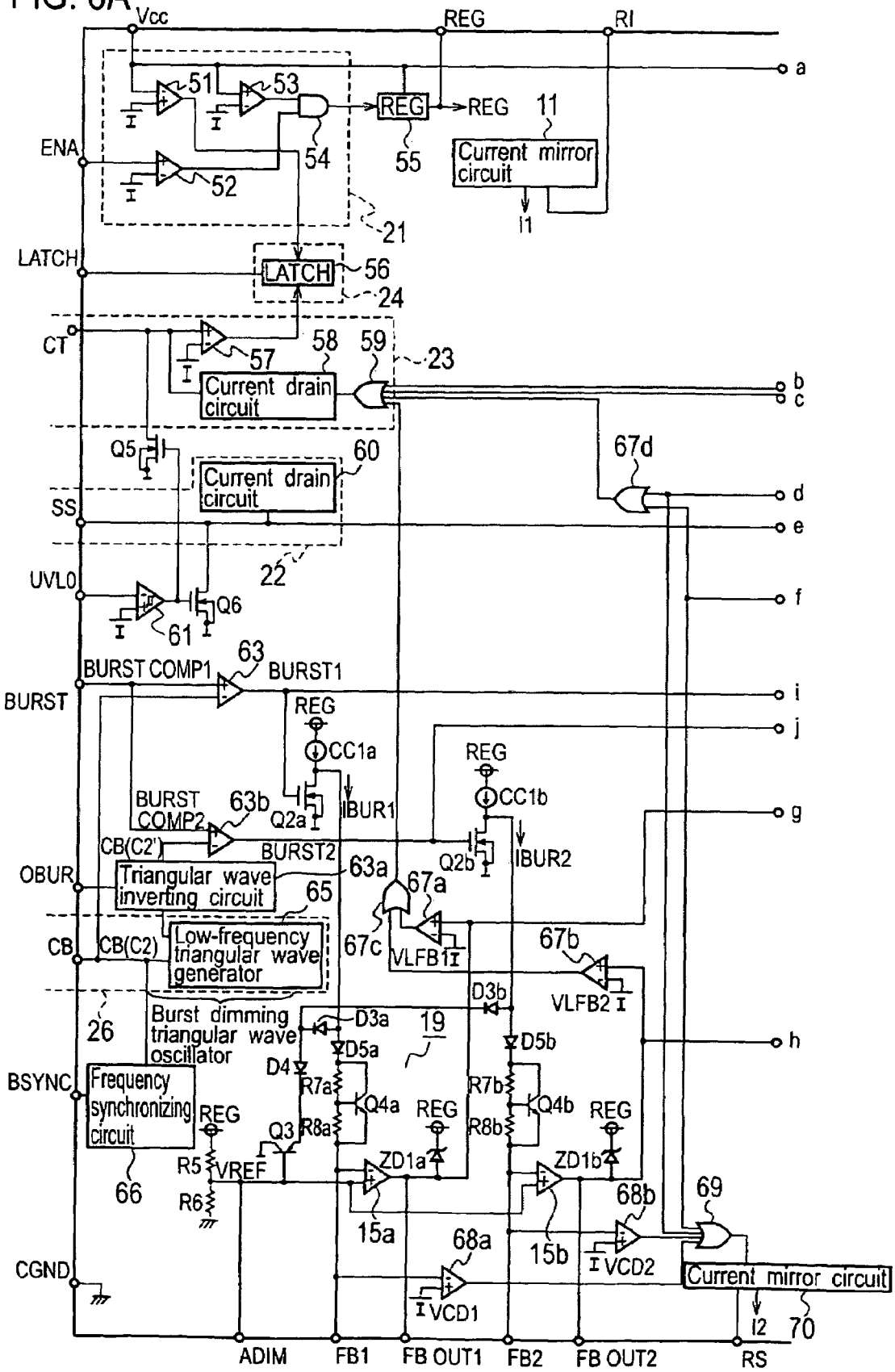
FIGS. 6A and 6B are circuit diagrams showing a semiconductor integrated circuit serving as a control circuit of a discharge lamp lighting apparatus according to a second embodiment of the present invention.
Figure 6B:
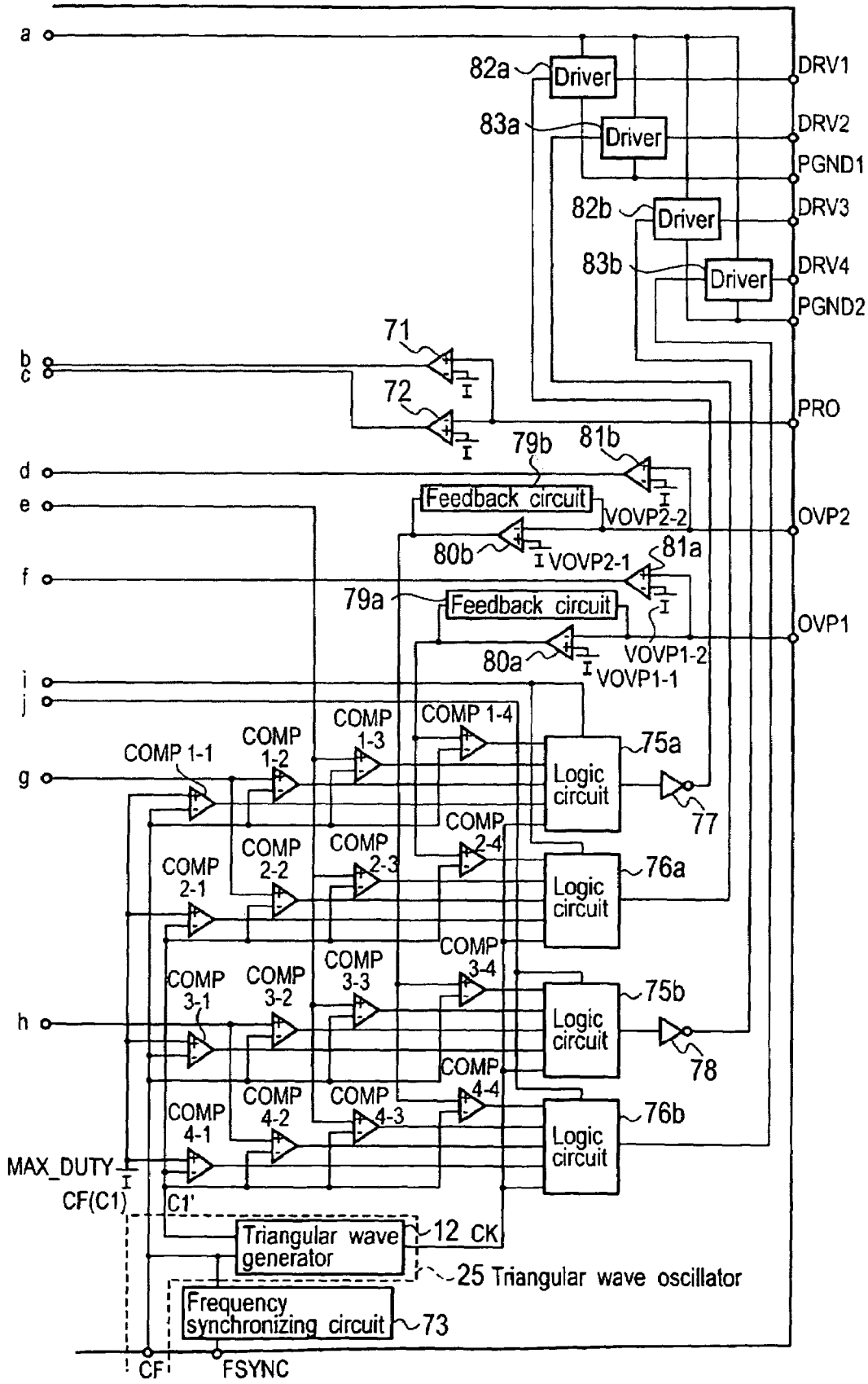
Figure 7:
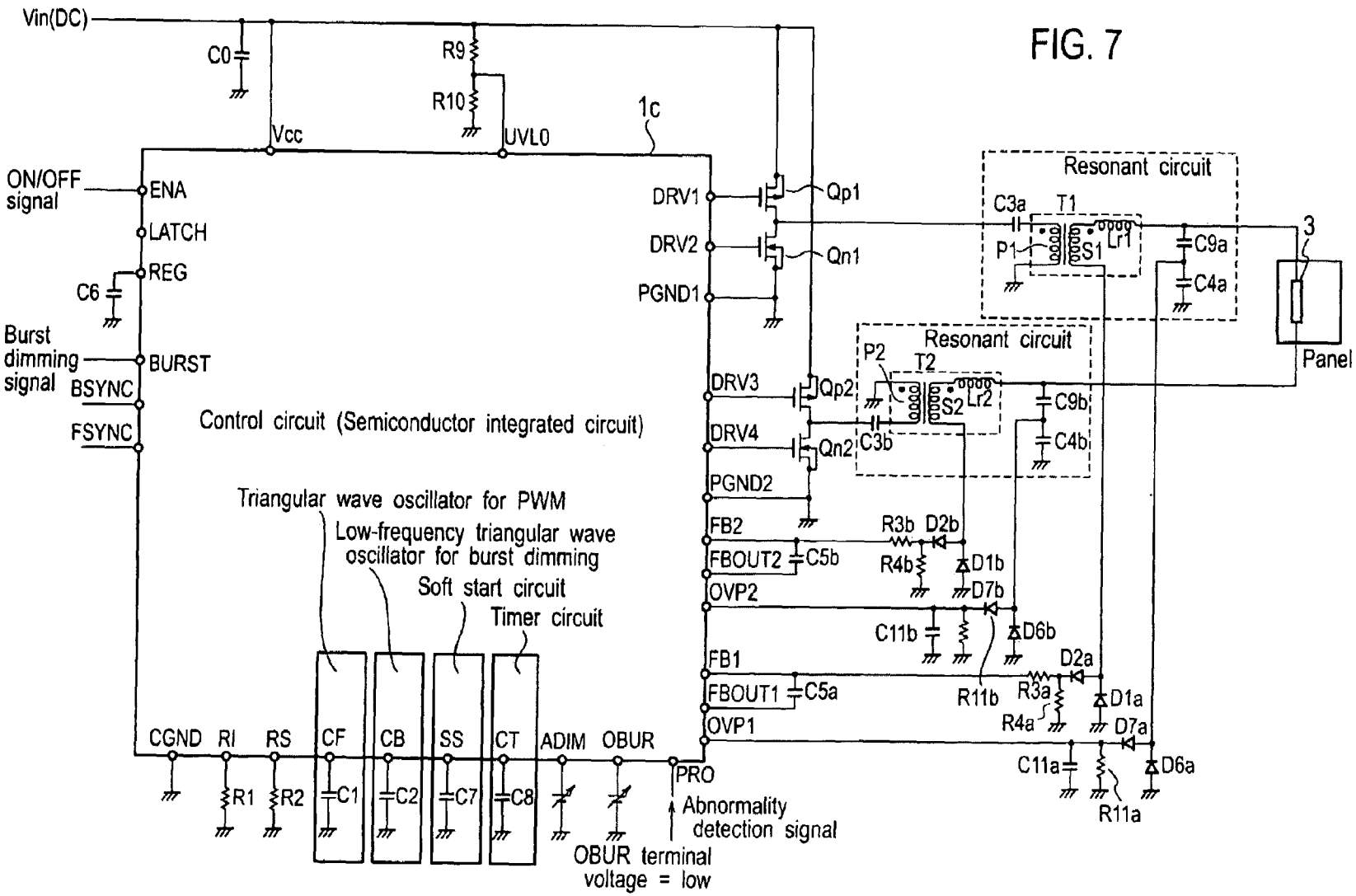
FIG. 7 is a circuit diagram showing the apparatus of the second embodiment.

FIG. 6A is a circuit diagram partly showing a semiconductor integrated circuit serving as a control circuit of a discharge lamp lighting apparatus according to the second embodiment of the present invention and FIG. 6B is a circuit diagram showing the remaining part of the semiconductor integrated circuit. Marks "a" to "j" shown in FIG. 6A correspond to marks "a" to "j" shown in FIG. 6B and points depicted by the same marks are connected to each other. FIG. 7 is a circuit diagram showing the discharge lamp lighting apparatus according to the second embodiment.

In FIGS. 6A and 6B, a burst comparator 63 compares a voltage supplied to a terminal BURST with a triangular signal CB(C2) that is generated by a low-frequency triangular wave oscillator 65 according to the voltage of a capacitor C2. If the voltage applied to the terminal BURST is equal to or lower than the triangular signal CB(C2), the burst comparator 63 provides an n-type FET Q2*a* with a low-level output to turn off the FET Q2*a* and pass a current from a terminal FB1.

A burst comparator 63*b* compares a signal C2' of a triangular wave inverting circuit 63*a* with the voltage supplied to the terminal BURST. If the voltage applied to the terminal BURST is equal to or smaller than the signal C2', the burst comparator 63*b* provides an n-type FET Q2*b* with a low-level output to turn off the FET Q2*b* and pass a current from a terminal FB2. The triangular wave inverting circuit 63*a* corresponds to a burst dimming mode switching unit according to the present invention. If no switching signal is supplied from a terminal OBUR to the triangular wave inverting circuit 63*a*, the signal C2' will be equal to the signal CB(C2). The burst comparators 63 and 63*b* correspond to a first burst dimming mode circuit according to the present invention and provide error amplifiers 15*a* and 15*b* with burst dimming signals in the same phase.

When a switching signal is supplied from the terminal OBUR to the triangular wave inverting circuit 63*a*, the triangular wave inverting circuit 63*a* provides a negative terminal of the burst comparator 63*b* with the inverted signal C2' formed by inverting the triangular signal from the triangular wave oscillator 65 with respect to a midpoint of upper and lower limit values of the triangular signal. The burst comparator 63*b* compares the inverted signal C2' of the triangular wave inverting circuit 63*a* with the voltage supplied from the terminal BURST and provides the n-type FET Q2*b* with the comparison result. The burst comparator 63*b* corresponds to a second burst dimming mode circuit according to the present invention and provides the error amplifiers 15*a* and 15*b* with burst dimming signals with a phase difference of 180 degrees.

Figure 8:
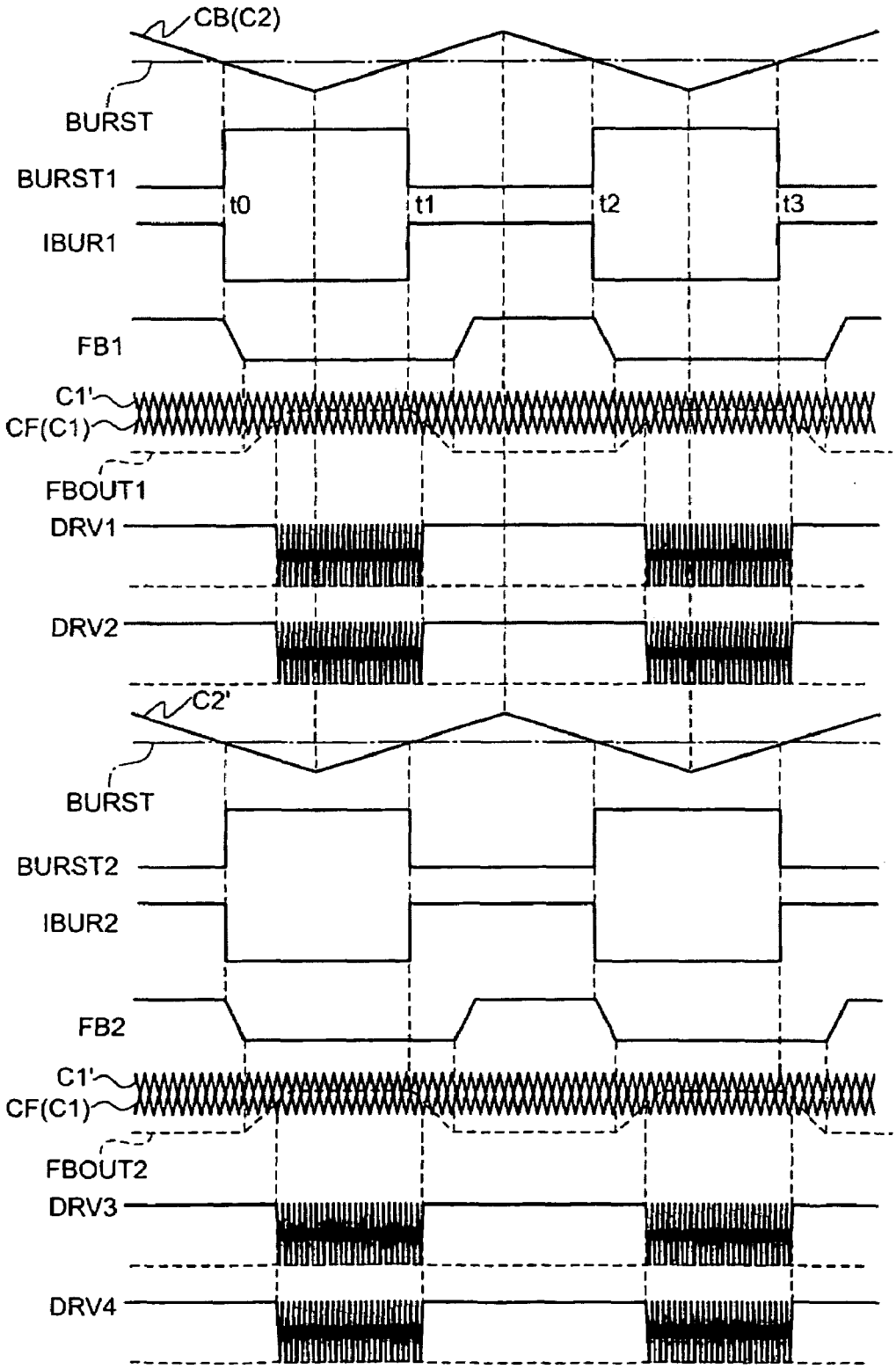
FIG. 8 is a view showing waveforms related to a burst dimming operation carried out by the apparatus of the second embodiment.

In FIG. 7, the discharge lamp lighting apparatus generates voltages of opposite phases at each end of a discharge lamp 3, to turn on the discharge lamp 3. To carry out a burst dimming operation, inphase intermittent oscillations should be applied to the ends of the discharge lamp 3. To achieve this, the switching signal from the terminal OBUR is set to low so that the triangular signal of the triangular wave inverting circuit 63*a* may not be inverted to make CB(C2') equal to CB(C2). As a result, inphase burst dimming signals are supplied to the error amplifiers 15*a* and 15*b* to carry out an inphase burst dimming operation. FIG. 8 shows waveforms related to the inphase burst dimming operation carried out by the discharge lamp lighting apparatus according to the second embodiment.

Figure 9:
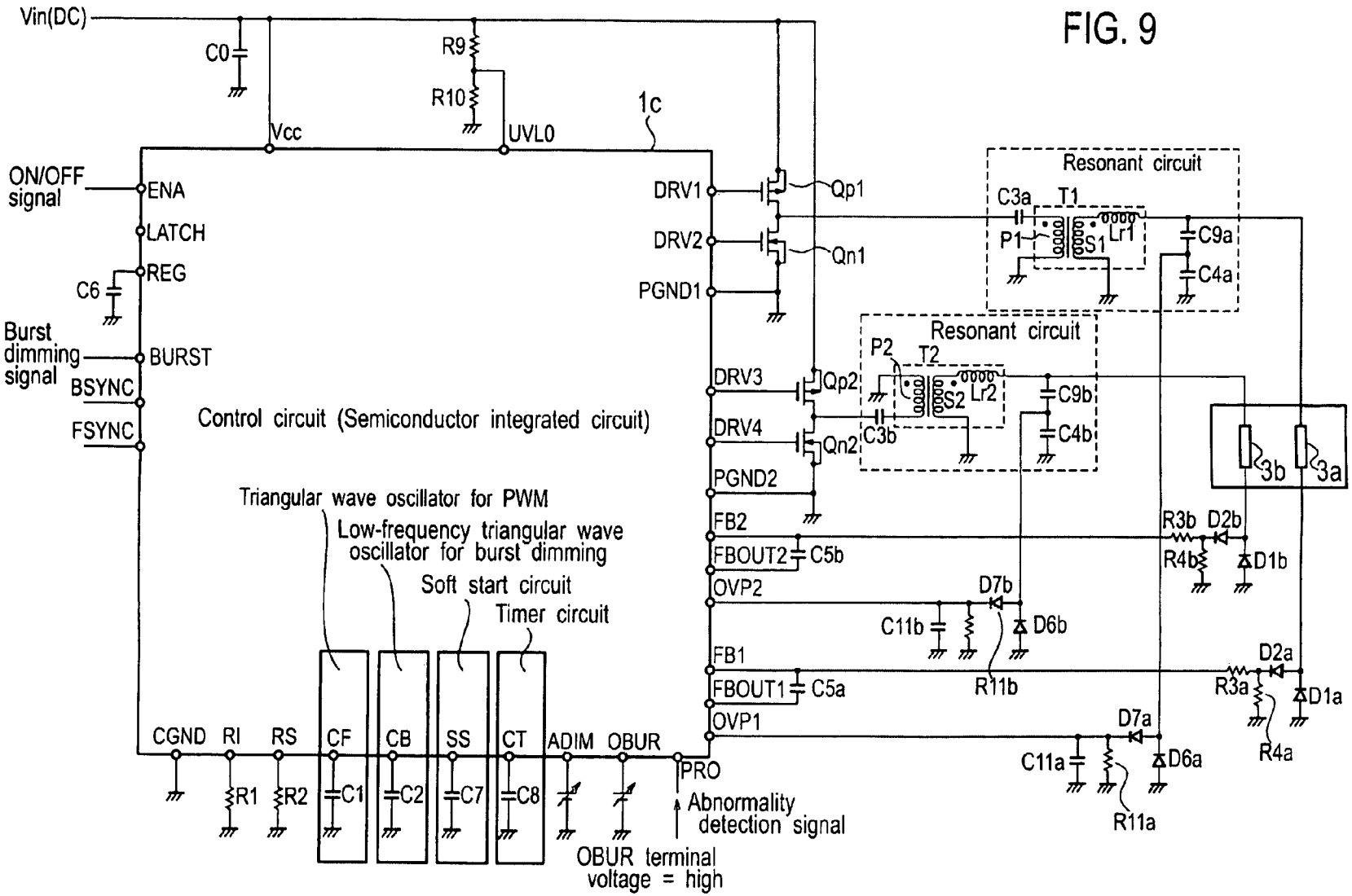
FIG. 9 is a circuit diagram showing a discharge lamp lighting apparatus according to a modification of the second embodiment.

FIG. 9 is a circuit diagram showing a discharge lamp lighting apparatus according to a modification of the second embodiment of the present invention. In FIG. 9, discharge lamps 3*a* and 3*b* are arranged in parallel. One end of the discharge lamp 3*a* is connected to one end of a secondary winding S1 of a transformer T1 and the other end of the discharge lamp 3*a* is connected to a terminal FB1 through a lamp current detector that includes diodes D1*a* and D2*a* and a resistor R4*a* and through a resistor R3*a*.

One end of the discharge lamp 3*b* is connected to one end of a secondary winding S2 of a transformer T2 and the other end of the discharge lamp 3*b* is connected to a terminal FB2 through a lamp current detector that includes diodes D1*b* and D2*b* and a resistor R4*b* and through a resistor R3*b*.

The other parts of the apparatus shown in FIG. 9 are the same as those of the apparatus shown in FIG. 7, and therefore, are not explained in detail.

Figure 10:
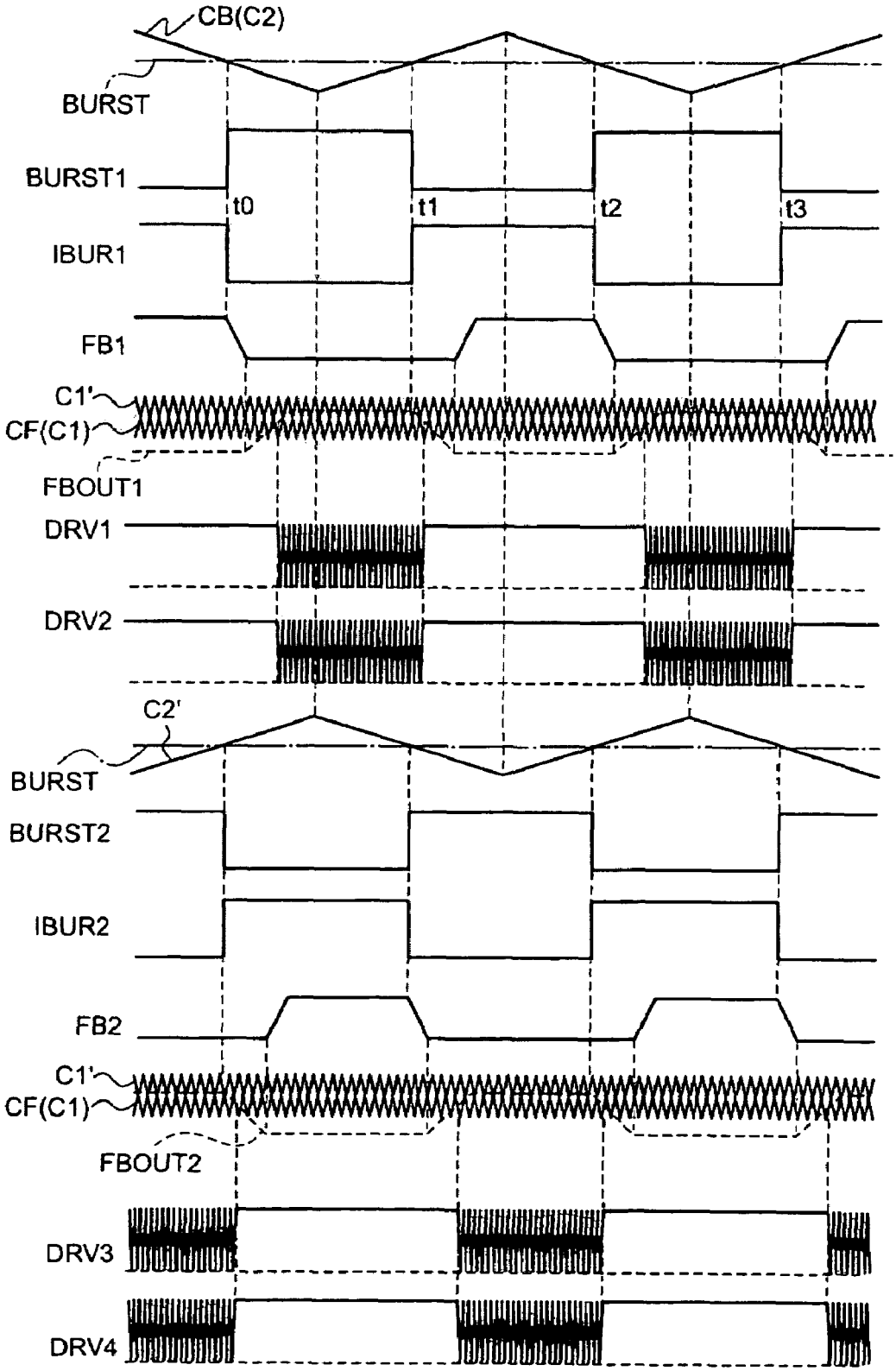
FIG. 10 is a view showing waveforms of a burst dimming operation with 180-degree phase difference according to the modification of the second embodiment.

To carry out a burst dimming operation of the parallel discharge lamps 3*a* and 3*b* with a phase difference of 180 degrees, a switching signal from the terminal OBUR is made high. Then, the triangular wave inverting circuit 63*a* inverts the triangular signal CB(C2) at a midpoint of the upper and lower limit values of the triangular signal and provides the burst comparator 63*b* with the inverted signal. Thus, the burst comparator 63*b* provides the error amplifiers 15*a* and 15*b* with burst dimming signals having a phase difference of 180 degrees to carry out the burst dimming operation of 180-degree phase difference. FIG. 10 shows waveforms related to the burst dimming operation of 180-degree phase difference according to the modification of the second embodiment.

As mentioned above, the discharge lamp lighting apparatus and semiconductor integrated circuit according to the present invention arrange the first to fourth switching elements on each side of a discharge lamp. These switching elements share an oscillator. The first control part controls the first and second switching elements according to a first PWM control signal with a phase difference of 180 degrees and a pulse width corresponding to a current passed through the secondary winding of the first transformer. The second control part controls the third and fourth switching elements in synchronization with the first PWM control signal with a phase difference of 180 degrees and a pulse width corresponding to a current passed through the secondary winding of the second transformer. The first and second control parts are arranged on opposite sides of the discharge lamp and individually conduct PWM control on the discharge lamp to stably turn on the discharge lamp even if peripheral capacitance values around the discharge lamp differ from one to another.

This application claims benefit of priority under 35 USC §119 to Japanese Patent Applications No. 2007-072093, filed on Mar. 20, 2007, the entire contents of which are incorporated by reference herein. Although the invention has been described above by reference to certain embodiments of the invention, the invention is not limited to the embodiments described above. Modifications and variations of the embodiments described above will occur to those skilled in the art, in light of the teachings. The scope of the invention is defined with reference to the following claims.

What is claimed is:

1. A discharge lamp lighting apparatus for converting a direct current into an alternating current of positive-negative symmetry and supplying power to a discharge lamp, comprising:

a first resonant circuit including a first transformer, a first capacitor connected to at least one of primary and secondary windings of the first transformer, and an output end connected to a first end of the discharge lamp;

first and second switching elements connected to ends of a DC power source and configured to pass a current through the primary winding of the first transformer and the first capacitor;

a second resonant circuit including a second transformer, a second capacitor connected to at least one of primary and secondary windings of the second transformer, and an output end connected to a second end of the discharge lamp, the second resonant circuit being configured to output an alternating current whose phase is opposite to the phase of an alternating current provided by the first resonant circuit;

third and fourth switching elements connected to the ends of the DC power source and configured to pass a current through the primary winding of the second transformer and the second capacitor;

an oscillator configured to generate a triangular signal;

a first control part configured to generate a first PWM control signal according to the triangular signal from the oscillator and an error voltage between a first reference voltage and a voltage corresponding to a first current passed through the secondary winding of the first transformer, the first PWM control signal being used to turn on/off the first and second switching elements with a phase difference of about 180 degrees and a pulse width corresponding to the first current; and a second control part configured to turn on/off the third and fourth switching elements in synchronization with the first PWM control signal and according to the triangular signal from the oscillator and an error voltage between a second reference voltage and a voltage corresponding to a second current passed through the secondary winding of the second transformer, with a phase difference of about 180 degrees and a pulse width corresponding to the second current, wherein PWM control operations are individually carried out to generate alternating currents of opposite phases that are applied to the ends of the discharge lamp.

2. The discharge lamp lighting apparatus of claim 1, further comprising a start-stop circuit, a soft start circuit, an output breaking circuit, and a burst dimming triangular wave oscillator those are shared by the first and second control parts, wherein:

at the start of operation of the discharge lamp lighting apparatus, the start-stop circuit and soft start circuit carry out an operation of gradually increasing the quantity of power to be supplied to the discharge lamp and supply power to the first and second control parts;

at the stoppage of operation of the discharge lamp lighting apparatus, the start-stop circuit stops power supplied to the first and second control parts;

at a burst dimming operation of the discharge lamp lighting apparatus, the burst dimming triangular wave oscillator provides the first and second control parts with a burst dimming signal so that power is intermittently supplied to the discharge lamp; and the output breaking circuit stops supplying power to the first and second control parts as an abnormality is detected.

3. The discharge lamp lighting apparatus of claim 2, further comprising:

a current detector configured to detect the first current passed through the secondary winding of the first transformer and the second current passed through the secondary winding of the second transformer; and a switching unit configured to set the oscillation frequency of the oscillator at a first oscillation frequency as the first and second currents detected by the current detector are equal to or larger than respective predetermined values, and set the oscillation frequency of the oscillator at a second oscillation frequency that is greater than the first oscillation frequency as any one of the first and second currents is lower than the corresponding predetermined value.

4. The discharge lamp lighting apparatus of claim 2, further comprising:

a voltage detector configured to detect a first voltage of the secondary winding of the first transformer and a second voltage of the secondary winding of the second transformer;

a current detector configured to detect the first current and second current; and a switching unit configured to set the oscillation frequency of the oscillator at a first oscillation frequency as the first and second currents are equal to or larger than respective predetermined currents and the first and second voltages are lower than respective predetermined voltages, and set the oscillation frequency of the oscillator at a second oscillation frequency that is greater than the first oscillation frequency as any one of the first and second currents is lower than the corresponding predetermined current or any one of the first and second voltages is equal to or larger than the corresponding predetermined voltage.

5. The discharge lamp lighting apparatus of claim 1, further comprising:

a current detector configured to detect the first current passed through the secondary winding of the first transformer and the second current passed through the secondary winding of the second transformer; and a switching unit configured to set the oscillation frequency of the oscillator at a first oscillation frequency as the first and second currents detected by the current detector are equal to or larger than respective predetermined values, and set the oscillation frequency of the oscillator at a second oscillation frequency that is greater than the first oscillation frequency as any one of the first and second currents is lower than the corresponding predetermined value.

6. The discharge lamp lighting apparatus of claim 1, further comprising:

a voltage detector configured to detect a first voltage of the secondary winding of the first transformer and a second voltage of the secondary winding of the second transformer;

a current detector configured to detect the first current and second current; and a switching unit configured to set the oscillation frequency of the oscillator at a first oscillation frequency as the first and second currents are equal to or larger than respective predetermined currents and the first and second voltages are lower than respective predetermined voltages, and set the oscillation frequency of the oscillator at a second oscillation frequency that is greater than the first oscillation frequency as any one of the first and second currents is lower than the corresponding predetermined current or any one of the first and second voltages is equal to or larger than the corresponding predetermined voltage.

7. A semiconductor integrated circuit for controlling a plurality of switching elements that supply power to a discharge lamp, the switching elements including first and second switching elements being connected to ends of a DC power source and passing a current through a primary winding of a first transformer and a first capacitor and third and fourth switching elements being connected to the ends of the DC power source and passing a current through a primary winding of a second transformer and a second capacitor, the semiconductor integrated circuit comprising:

an oscillator configured to generate a triangular signal;

a first control part configured to generate a first PWM control signal according to the triangular signal of the oscillator and an error voltage between a first reference voltage and a voltage corresponding to a first current passed through the secondary winding of the first transformer, the first PWM control signal being used to turn on/off the first and second switching elements with a phase difference of about 180 degrees and a pulse width corresponding to the first current; and a second control part configured to turn on/off the third and fourth switching elements in synchronization with the first PWM control signal and according to the triangular signal of the oscillator and an error voltage between a second reference voltage and a voltage corresponding to a second current passed through the secondary winding of the second transformer, with a phase difference of substantially 180 degrees and a pulse width corresponding to the second current.

8. The semiconductor integrated circuit of claim 7, further comprising a start-stop circuit, a soft start circuit, an output breaking circuit, and a burst dimming triangular wave oscillator those are shared by the first and second control parts, wherein:

at the start of operation of a discharge lamp lighting apparatus, the start-stop circuit and soft start circuit carry out an operation of gradually increasing the quantity of power to be supplied to the discharge lamp and supply power to the first and second control parts;

at the stoppage of operation of the discharge lamp lighting apparatus, the start-stop circuit stops power supplied to the first and second control parts;

at a burst dimming operation of the discharge lamp lighting apparatus, the burst dimming triangular wave oscillator provides the first and second control parts with a burst dimming signal so that power is intermittently supplied to the discharge lamp; and the output breaking circuit stops supplying power to the first and second control parts as an abnormality is detected.

9. The semiconductor integrated circuit of claim 8, further comprising a switching unit configured to set the oscillation frequency of the oscillator at a first oscillation frequency if a first current passed through the secondary winding of the first transformer connected to a first end of the discharge lamp and a second current passed through the secondary winding of the second transformer connected to a second end of the discharge lamp are equal to or larger than respective predetermined values, and set the oscillation frequency of the oscillator at a second oscillation frequency that is greater than the first oscillation frequency as any one of the first and second currents is lower than the corresponding predetermined value.

10. The semiconductor integrated circuit of claim 8, further comprising:

a switching unit configured to set the oscillation frequency of the oscillator at a first oscillation frequency as a first current passed through the secondary winding of the first transformer connected to a first end of the discharge lamp and a second current passed through the secondary winding of the second transformer connected to a second end of the discharge lamp are equal to or larger than respective predetermined values and a first voltage of the secondary winding of the first transformer and a second voltage of the secondary winding of the second transformer are lower than respective predetermined voltages, and set the oscillation frequency of the oscillator at a second oscillation frequency that is greater than the first oscillation frequency as any one of the first and second currents is lower than the corresponding predetermined value and any one of the first and second voltages is equal to or larger than the corresponding predetermined value.

11. The semiconductor integrated of claim 8, further comprising:

a first burst dimming mode circuit configured to provide the first and second control parts with burst dimming signals of the same phase, the burst dimming signals being used to intermittently supply power to the discharge lamp;

a second burst dimming mode circuit configured to provide the first and second control parts with burst dimming signals with a phase difference of 180 degrees, the burst dimming signals being used to intermittently supply power to the discharge lamp; and a burst mode switching unit configured to switch the first and second burst dimming mode circuits from one to another according to a switching signal.

12. The semiconductor integrated circuit of claim 7, further comprising a switching unit configured to set the oscillation frequency of the oscillator at a first oscillation frequency if a first current passed through the secondary winding of the first transformer connected to a first end of the discharge lamp and a second current passed through the secondary winding of the second transformer connected to a second end of the discharge lamp are equal to or larger than respective predetermined values, and set the oscillation frequency of the oscillator at a second oscillation frequency that is greater than the first oscillation frequency as any one of the first and second currents is lower than the corresponding predetermined value.

13. The semiconductor integrated circuit of claim 7, further comprising:

a switching unit configured to set the oscillation frequency of the oscillator at a first oscillation frequency as a first current passed through the secondary winding of the first transformer connected to a first end of the discharge lamp and a second current passed through the secondary winding of the second transformer connected to a second end of the discharge lamp are equal to or larger than respective predetermined values and a first voltage of the secondary winding of the first transformer and a second voltage of the secondary winding of the second transformer are lower than respective predetermined voltages, and set the oscillation frequency of the oscillator at a second oscillation frequency that is greater than the first oscillation frequency as any one of the first and second currents is lower than the corresponding predetermined value and any one of the first and second voltages is equal to or larger than the corresponding predetermined value.

14. The semiconductor integrated circuit of claim 7, further comprising:

a first burst dimming mode circuit configured to provide the first and second control parts with burst dimming signals of the same phase, the burst dimming signals being used to intermittently supply power to the discharge lamp;

a second burst dimming mode circuit configured to provide the first and second control parts with burst dimming signals with a phase difference of 180 degrees, the burst dimming signals being used to intermittently supply power to the discharge lamp; and a burst mode switching unit configured to switch the first and second burst dimming mode circuits from one to another according to a switching signal.

* * * * *